US009712275B2

(12) United States Patent
Johnson et al.

(10) Patent No.: US 9,712,275 B2
(45) Date of Patent: Jul. 18, 2017

(54) WAVEFORM-ENABLED JAMMER EXCISION (WEJE)

(71) Applicant: LOCKHEED MARTIN CORPORATION, Bethesda, MD (US)

(72) Inventors: Russell K. Johnson, Half Moon Bay, CA (US); James Alan Ivey, Palo Alto, CA (US); Yadunath Bhagvantrao Zambre, Los Altos Hills, CA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 294 days.

(21) Appl. No.: 13/971,813

(22) Filed: Aug. 20, 2013

(65) Prior Publication Data

US 2015/0256286 A1 Sep. 10, 2015

Related U.S. Application Data

(60) Provisional application No. 61/692,200, filed on Aug. 22, 2012.

(51) Int. Cl.
*H04K 3/00* (2006.01)
*H01Q 3/26* (2006.01)

(52) U.S. Cl.
CPC ..... *H04K 3/44* (2013.01); *H01Q 3/2605* (2013.01); *H01Q 3/2617* (2013.01); *H04K 3/228* (2013.01); *H04K 3/43* (2013.01); *H04K 3/45* (2013.01); *H04K 2203/32* (2013.01)

(58) Field of Classification Search
CPC .... H04B 1/126; H04B 7/0639; H04B 7/0634; H04B 1/71; H04B 1/7143; H04B 17/345; G01S 7/2813; H01Q 3/2611; H01Q 21/0006; H01Q 3/26; H01Q 1/282; H01Q 1/36; H01Q 21/22; H01Q 1/246; H04L 1/16
See application file for complete search history.

(56) References Cited

U.S. PATENT DOCUMENTS

| | | | | |
|---|---|---|---|---|
| 4,780,721 | A * | 10/1988 | Dobson | 342/178 |
| 5,164,738 | A * | 11/1992 | Walter | 343/789 |
| 6,141,371 | A * | 10/2000 | Holmes et al. | 375/130 |
| 6,598,014 | B1 | 7/2003 | Rabideau et al. | |
| 7,064,710 | B1 * | 6/2006 | Ksienski et al. | 342/372 |
| 2002/0150147 | A1 * | 10/2002 | Liang | 375/133 |

(Continued)

OTHER PUBLICATIONS

Rao et al, MRC and OC in antenna array, 2011 http://ieeexplore.ieee.org/stamp/stamp.jsp?arnumber=940267.*

*Primary Examiner* — Ping Hsieh
*Assistant Examiner* — James Yang
(74) *Attorney, Agent, or Firm* — McDermott Will & Emery LLP

(57) ABSTRACT

A method for waveform-enabled jammer excision (WEJE) may include performing a jammer measurement during a look-through window when no signal-of-interest (SOI) is present and obtaining a jammer signal. A SOI-plus-jammer measurement may be performed and a SOI-plus-Jammer signal may be obtained when both the jammer signal and the SOI are present. Optimal weights that maximize a SOI-to-jammer power ratio may be determined. SOI-plus-jammer signals from a number of antenna elements may be optimally weighted and combined to copy the SOI and null the jammer signal based on the determined optimal weights.

20 Claims, 7 Drawing Sheets

(56) References Cited

U.S. PATENT DOCUMENTS

| | | | | |
|---|---|---|---|---|
| 2006/0068715 | A1* | 3/2006 | Hundal et al. | 455/67.11 |
| 2006/0181456 | A1* | 8/2006 | Dai | 342/377 |
| 2007/0263748 | A1* | 11/2007 | Mesecher | 375/299 |
| 2009/0276674 | A1* | 11/2009 | Wei et al. | 714/749 |
| 2010/0149068 | A1* | 6/2010 | Petersson et al. | 343/893 |
| 2011/0045782 | A1* | 2/2011 | Shin et al. | 455/67.13 |

* cited by examiner

WAVEFORM-ENABLED JAMMER EXCISION (WEJE)

CROSS-REFERENCE TO RELATED APPLICATIONS

This application claims the benefit of priority under 35 U.S.C. §119 from the U.S. Provisional Patent Application 61/692,200 filed Aug. 22, 2012, which is incorporated herein by reference in its entirety.

STATEMENT REGARDING FEDERALLY SPONSORED RESEARCH OR DEVELOPMENT

Not applicable.

FIELD OF THE INVENTION

The present invention generally relates to communications, and more particularly to waveform-enabled jammer excision (WEJE).

BACKGROUND

Communications and surveillance jammers are common in almost every channel of communication. Radio jamming, radar jamming and deception, and mobile phone jamming, may be among the most encountered forms of jamming interferences. Many communications and surveillance systems may need to be equipped with anti jamming equipment or devices to prevent or resist being jammed by interferers.

There are several existing techniques for performing interference or jammer cancellation on radio frequency signals. These techniques may fall into six general categories: (1) fixed or adaptive signal modulation; (2) fixed or adaptive forward error correction (FEC) or coding; (3) fixed spatial antenna patterns; (4) adaptive spatial antenna patterns; (5) spectrum spreading (e.g., direct sequence spread spectrum (DSSS), frequency hopping, or both); and (6) temporal cancellation. Often, combinations of these techniques may be used simultaneously. An exemplar system might include a combination of categories (1), (2), (3), (5), and (6) simultaneously. Such a system may include a range of adaptive modulations and coding. The more robust modulations and FEC coding (e.g., those that require lower energy-per-bit-to-noise-density ratio (Eb/No) may be used when jamming is detected to increase communication robustness. More bandwidth efficient modulations and coding would be used when no jamming is detected. This system may use fixed sector antenna patterns (3) to reduce interference or jamming that originates outside of its intended sector. Finally, this system might also use either a direct sequence spread spectrum (DSSS) modulation or frequency-hop its signal to reduce the effect of jammers.

One method of jammer excision involves a beamforming technique that combines a jammer plus Signal-of-Interest (SOI) autocorrelation measurement with a constraint vector (aka constraint vector). The system of the subject technology can null all received energy except in the direction of the constraint vector. If the constraint vector is pointing at the SOI then the jammer is nulled and the SOI is copied. In this technique, to constrain the beam-former from nulling the SOI, a constraint aperture vector may be employed. The constraint aperture vector may be based on measuring correlation against pilot signals embedded in the SOI. In order to obtain an accurate estimate of the constraint aperture vector, the system may have to perform correlation for a very long period of time. This technique can be slow and impractical in the real world because during this very long correlation interval (e.g., minutes), it may be difficult to maintain synchronization using the pilot symbols under heavy interference. SOI motion during this long interval can be less predictable because it may be non-linear with continuous change in direction and velocity. Accordingly, SOI experiences phase rotation due to motion induced Doppler Effect that can result in unpredictable synchronization drift, which can prevent obtaining a clean constant vector. Therefore, the need exist for a faster and more practical approach for jammer excision.

SUMMARY

In some aspects, a system for communication (e.g., satellite communication) is described. The system can facilitate waveform-enabled jammer excision (WEJE) and may include multiple antennas configured to enable communication over a coverage area through a plurality of antenna beams. Multiple radio circuits may be coupled to the multiple antennas and configured to determine a look-through window during which no signal-of-interest (SOI) is present and only jammer is present. A weight processor may be coupled to the multiple radio circuits and configured to receive a jammer signal during the look-through window and a SOI-plus jammer signal when both the jammer signal and the SOI are present. The weight processor may determine optimal weights that maximize a SOI-to-jammer power ratio. A baseband processor may be coupled to the plurality of radio circuits and the weight processor and is configured to receive the jammer signal and the SOI-plus-jammer signal from the multiple radio circuits. The baseband processor may receive the optimal weights from the weight processor and optimally weight and combine SOI-plus-jammer signals received from a number of antenna elements to copy the SOI and null the jammer signal based on the determined optimal weights.

In other aspects, a method for waveform-enabled jammer excision (WEJE) includes performing a jammer measurement during a look-through window when no signal-of-interest (SOI) is present and obtaining a jammer signal. A SOI-plus-jammer measurement may be performed and a SOI-plus-Jammer signal may be obtained when both the jammer signal and the SOI are present. Optimal weights that maximize a SOI-to-jammer power ratio may be determined. SOI-plus-jammer signals from a number of antenna elements may be optimally weighted and combined to copy the SOI and null the jammer signal based on the determined optimal weights.

In yet other aspects, a satellite communication system may include multiple multi-beam antennas (MBAs) arranged at wide separations. Each MBA may be configured to communicate through multiple beams pointed at different regions on the earth. Multiple radio circuits may be coupled to the multiple MBAs and configured to measure a jammer signal during a look-through window when no signal-of-interest (SOI) present and SOI-plus-jammer signal when both the jammer signal and the SOI are present. A weight processor may be coupled to the multiple radio circuits and be configured to receive a jammer signal and the SOI-plus-jammer signal. Optimal weights that maximize a SOI-to-jammer power ratio may be determined based on the received jammer signal and the SOI-plus-jammer signal. A baseband processor coupled to the plurality of radio circuits and the weight processor may be configured to receive the jammer signal and the SOI-plus-jammer signal from the plurality of radio circuit, and to receive the optimal weights from the weight processor. The baseband processor may optimally weight and combine SOI-plus-jammer signals from a number of antenna elements and optimally copy the SOI and null the jammer signal based on the determined optimal weights.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION

The present disclosure is directed, in part, to methods and configuration for waveform-enabled jammer excision (WEJE). The subject technology is generally directed to design modifications of the transmission waveform that may provide microsecond 'look-through' windows to measure the jammers precisely. This provision, coupled with jammer plus signal-of-interest (SOI) measurements made when the SOI is transmitting, can allow precise SOI copy weights and nuller excision to occur. In some aspects of the subject technology, one or more mathematical expressions for a rapid computation of the jammer nulling and SOI copy weights are provided.

In one or more aspects, the disclosed technology addresses a new super-fast, optimal, adaptive and robust spatial/temporal technique for radio frequency jammer suppression and simultaneous signal copy of SOI that is applicable to frequency hopped signals, or time division multiple-access (TDMA) signals. The WEJE technique disclosed herein can perform adaptive spatial interference cancellation and temporal interference cancellation simultaneously. The disclosed WEJE technique can be used in conjunction with other techniques such as adaptive modulation, adaptive coding, and spectrum spreading.

Most military communication signals may be subject to electronic countermeasures (EC) and jamming during wartime in contested theaters. This may be particularly true for communication satellite uplink signals because uplink jammers can be located anywhere within or near the uplink beam and can produce very effective jamming. The disclosed WEJE technique may use a WEJE interfere cancellation technique, which can be an optimal spatial/temporal interference cancellation technique tailored for frequency-hopped signals. The WEJE may produce maximum signal-to-interference plus noise (SINR) weights for frequency-hopped signals to copy the SOI and null in-band jammer signals. The WEJE can form the optimal SOI beamforming and jammer nulling weight vector in a substantially short time with minimal number of aperture samples.

Figure 1:
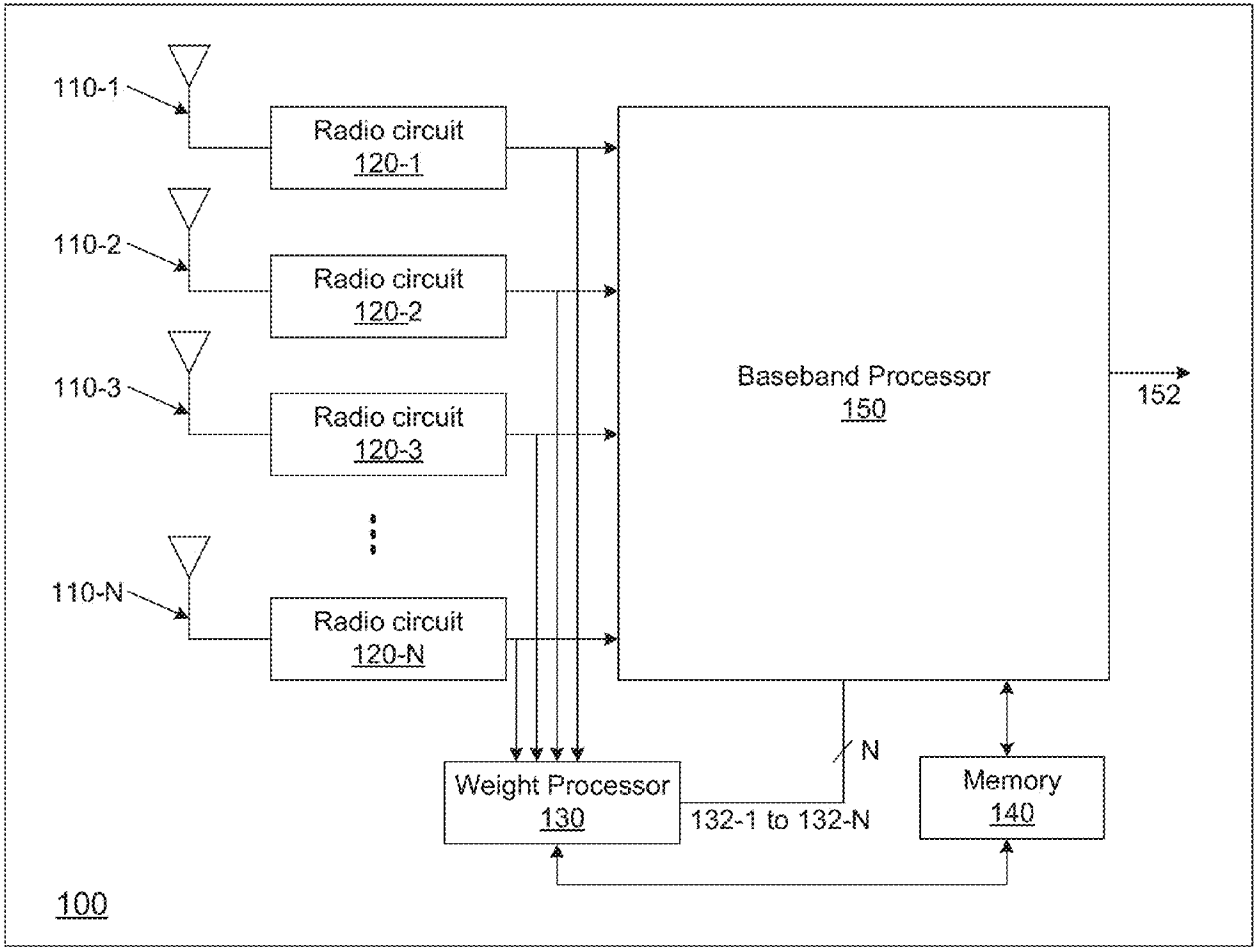
FIG. 1 is a conceptual diagram illustrating a high-level block diagram of an example of a waveform-enabled jammer excision system, according to certain aspects.

FIG. 1 is a conceptual diagram illustrating a high-level block diagram of an example of a WEJE system 100, according to certain aspects of the subject technology. The example WEJE system 100 includes multiple (e.g., N, such as 10) antennas 110-1 to 110-N, a number of radio circuits 120-1 to 120-N, a baseband processor 150, a weight processor 130, and memory 140. The antennas 110-1 to 110-N may be configured to enable communication over a coverage area through several antenna beams. The radio circuits 120-1 to 120-N may be coupled to the multiple antennas and configured to determine a look-through window during which no signal-of-interest (SOI) is present. The weight processor 130 is coupled to the multiple radio circuits 110-1 to 110-N and is configured to receive a jammer signal during the look-through window and a SOI-plus-jammer signal when both the jammer signal and the SOI are present. The weight processor 130 can determine optimal weights that maximize a SOI-to-jammer power ratio, as discussed in greater detail herein. The baseband processor 150 is coupled to the radio circuits 120-1 to 120-N and the weight processor 130. The baseband processor 150 may and is configured to receive the jammer signal and the SOI-plus-jammer signal from the multiple radio circuits 120-1 to 120-N. The baseband processor 150 can be a WEJE processor that receives the optimal weights 132-1 to 132-N from the weight processor 130 and can optimally weight and combine SOI-plus-jammer signals from a number of antenna elements to copy the SOI and null the jammer signal based on the determined optimal weights 132-1 to 132-N, as further described herein.

In one or more implementations, examples of the baseband processor 150 includes a general-purpose processor (e.g., a central processing unit (CPU)), a multi-core processor, a microcontroller, a digital signal processor (DSP), an application specific integrated circuit (ASIC), a field-programmable gate array (FPGA), a programmable logic device (PLD), a controller, a state machine, gated logic, discrete hardware components, or any other suitable entity that can perform calculations or other manipulations of information or execute algorithms. In some aspects, the memory 140 includes random access memory (RAM), dynamic RAM (DRAM), static Ram (SRAM), flash memory, processor cache or register, or any suitable storage media.

Figure 2B:
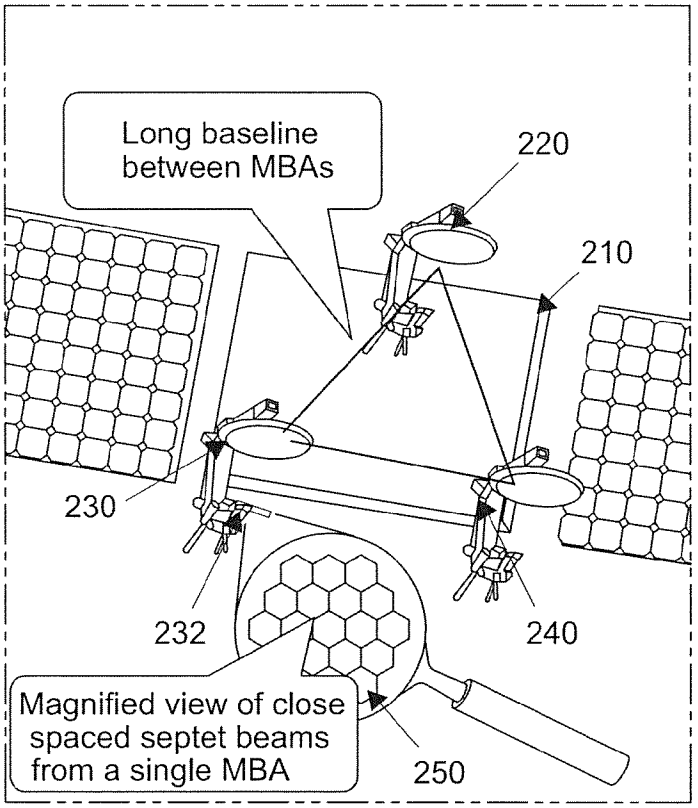
FIG. 2B is a diagram illustrating an example of a satellite system employing three MBAs, according to certain aspects.
Figure 2A:
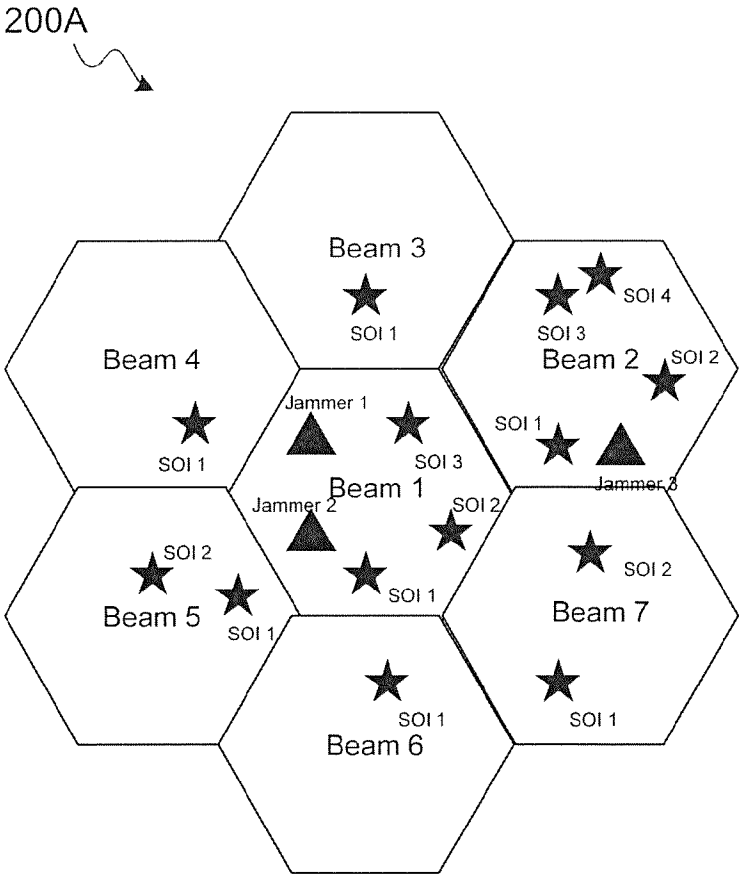
FIG. 2A is a diagram illustrating a multi-beam antenna pattern of an exemplary multi-beam antenna (MBA) for the system of FIG. 1, according to certain aspects.

FIG. 2A is a diagram illustrating a multi-beam antenna pattern 200A of an exemplary multi-beam antenna (MBA) for the system 100 of FIG. 1, according to certain aspects of the subject technology. The exemplary MBA, for which the antenna patterns are shown, has 7 antenna beams that can enable communication over the coverage area of interest. Each beam may include one or more signals-of-interest (SOIs) shown as stars in FIG. 2A, and zero or more jammers or interferers shown as triangles. For example the middle antenna beam (e.g., beam 1), as shown, includes three signals of interest (e.g., SOI1-SOI3) and two jammer signals (e.g., jammer 1 and jammer 2), whereas beams 3, 4, and 6 each include only one SOI.

The antenna beams 1-7 can be formed via a single MBA, by separate gimbaled dish antennas (GDAs), or by antennas of other types. As shown, jammers located in beams 1 and beam 2 are in-beam jammers, therefore, the antenna pattern 200A of the beams may not offer any protection to the SOIs in these beams (e.g., beam 1 and 2). Other means, such as the disclosed WEJE along with the spread spectrum techniques can be applied to protect these beams from strong jammers or interferers. Even adjacent beams can be affected by jammers if the respective powers of the jammers at the receiver are sufficiently strong. A typical satellite may employ multiple apertures with patterns similar to the antenna pattern 200A.

FIG. 2B is a diagram illustrating an example of a satellite system 200B employing three MBAs 220, 230, and 240, according to certain aspects of the subject technology. The satellite system 200B includes a nadir deck 210 and hosts three MBAs 220, 230, and 240. The MBAs 220, 230, and 240, as shown, may be arranged in an equal-lateral triangle on the satellites nadir deck 210. Each MBA, for example, MBA 230, may include MBA feed elements (e.g., 232) with beams forming an antenna pattern (e.g., 250). In one or more aspects, the antenna elements may have different gains. The beams for each MBA can be pointed at different areas on the earth to provide communication to various regions, or alternatively, all three MBAs can be pointed at the same geographic location on the earth to create a sparse aperture (SA) system that can provide multiple spatial antenna feeds to a spatial/temporal processor such as WEJE processor (e.g., baseband processor 150 of FIG. 1). In one or more implementations, the subject technology can provide beam-forming and nulling that can operate with M MBAs, where each MBA includes B beams and (M−1)*B jammer nulls can be formed and SOIs can be copied within the beams. For example, for 3 MBAs, each having 7 beams, a total of 14 jammer nulls may be formed.

Figure 3:
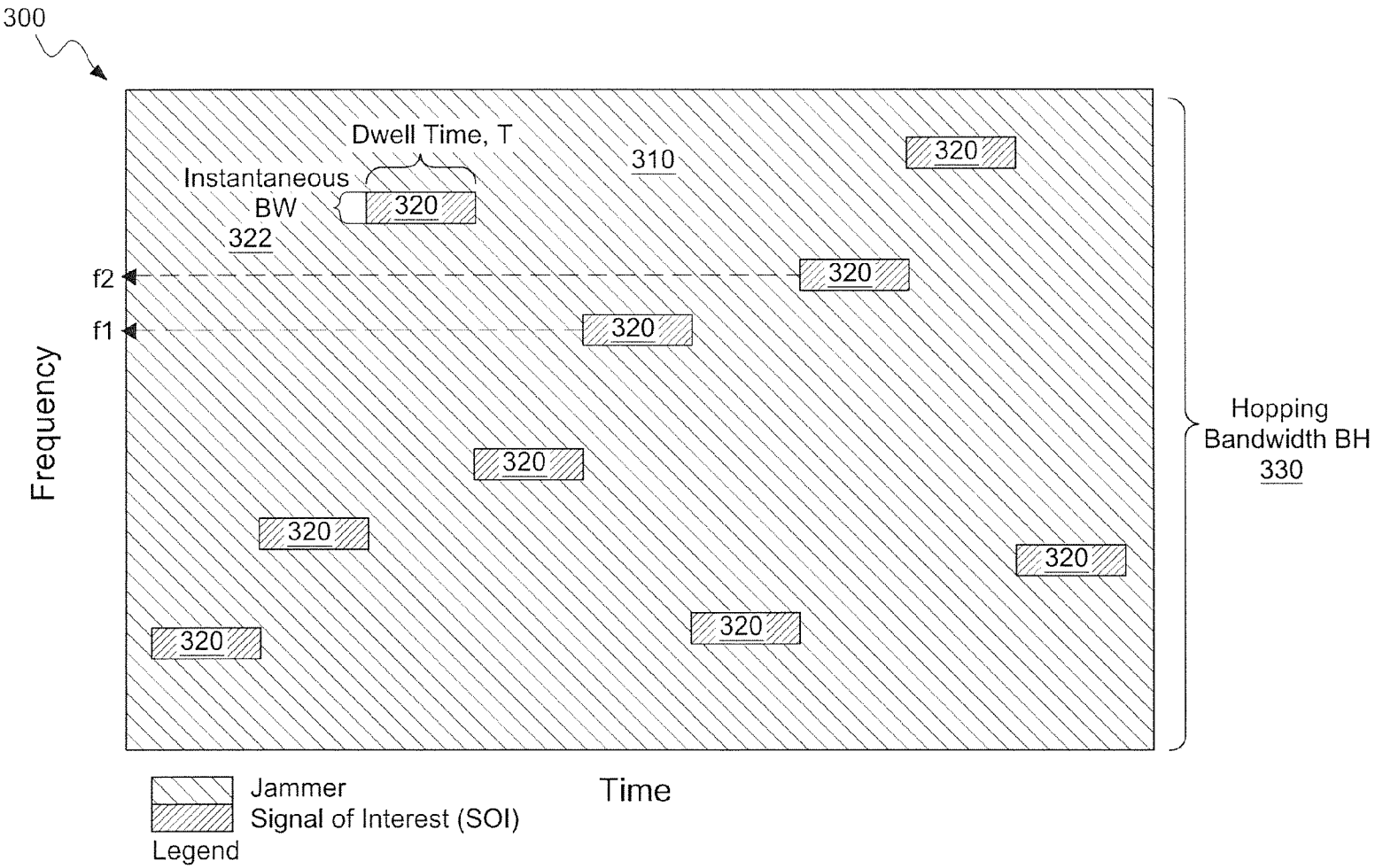
FIG. 3 is a diagram illustrating an example time-frequency plot of a number of frequency hopped signals, according to certain aspects.

FIG. 3 is a diagram illustrating an example time-frequency plot 300 of a number of frequency hopped signals, according to certain aspects of the subject technology. In the frequency-hopped signal and jamming environment shown in FIG. 3, the rectangles 320 represent the SOI frequency hopping in time. The background 310 represents a jammer signal spread over time and frequency. After each hop time-dwell, $T_H$, the SOI may hop to a new pseudo randomly selected frequency (e.g., f1 or f2). The instantaneous bandwidth (BW) of the frequency-hopped SOI may be a small portion of a full-hopping/spreading bandwidth BH (e.g., 330). The SOI may spend one hop dwell-time, $T_H$, on each pseudo randomly selected frequency (e.g., f1) and then may jump to a new pseudo randomly selected frequency (e.g., f2).

An effective jammer may be forced to spread its energy in some manner across the full-spreading bandwidth BH, or may spread its energy, over a subset of the full-spreading bandwidth BH, thus thinning the jammer power within any narrow bandwidth BW. Since the jammer is not aware of the instantaneous operating frequency of the SOI (e.g., f1 or f2), the jammer may often spread its energy across the entire or some subsets of the full-hopping bandwidth BH. This may result in a frequency-hop processing-gain for the SOI equal to the ratio of the full-hopping bandwidth BH to SOI bandwidth BW, which can represent a significant signal processing gain over the jammer, but may not be sufficient to meet anti jam requirements of a desired system. The spatial/temporal WEJE disclosed herein, can readily fulfill the anti jam requirements of the desired system.

In one or more implementations, the subject spatial/temporal WEJE technique can combine signals from multiple antenna elements that are spatially separated, either by a short distance, or a long distance, or a combination of short and long distances, combine time delayed versions of these signals to copy SOIs and null jammers. The disclosed WEJE technique can determine the weights to null jammer and copy SOIs nearly instantaneously, and does not require any knowledge of the array manifold, the direction-of-arrival of jammers, nor the direction-of-arrival of the SOI.

Figure 4:
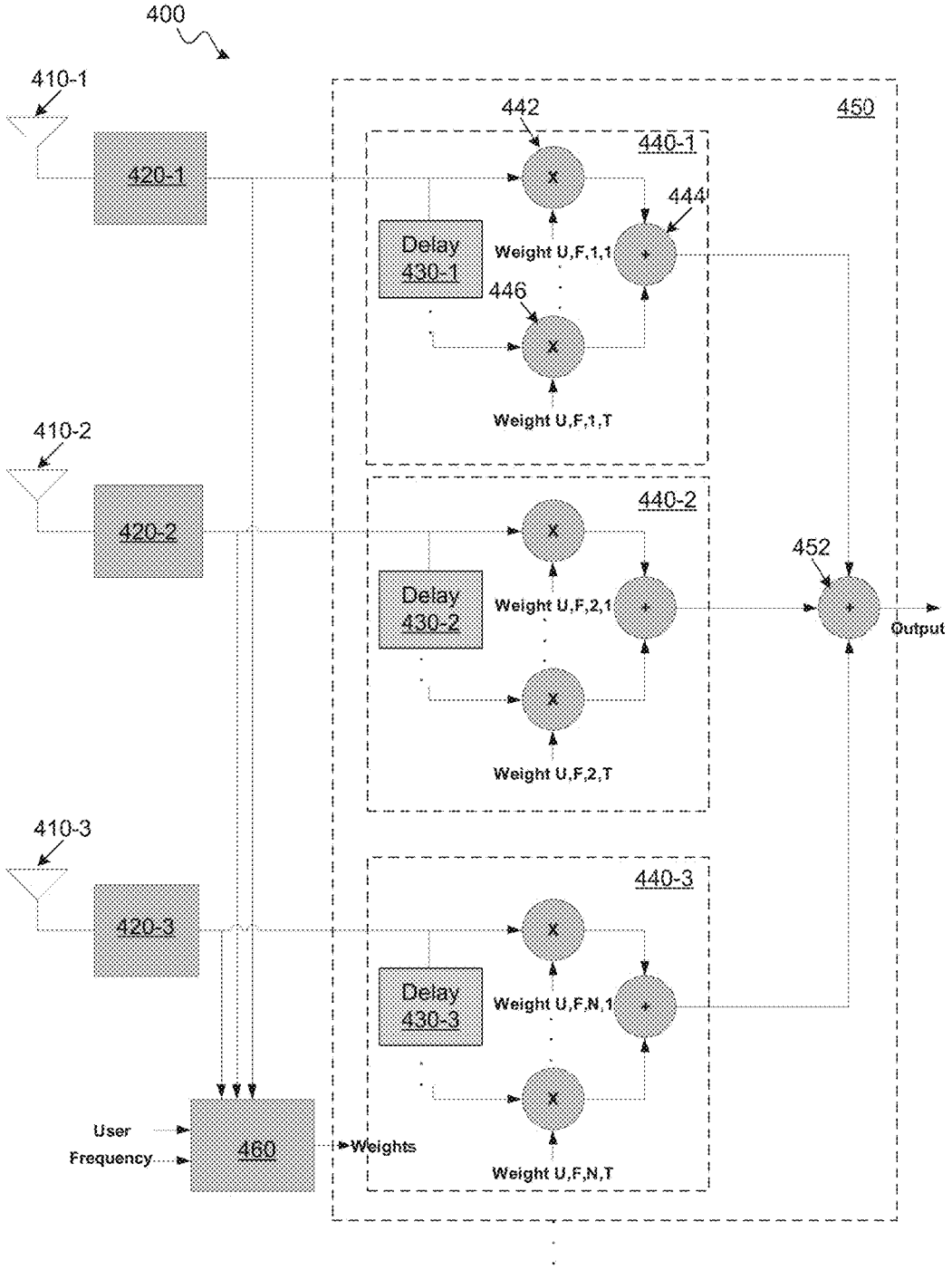
FIG. 4 is a conceptual diagram illustrating an example of a system for waveform-enabled jammer excision, according to certain aspects.

FIG. 4 a conceptual diagram illustrating an example of a system 400 for waveform-enabled jammer excision, according to certain aspects of the subject technology. The system 400 includes, a number of antenna elements (e.g., 410-1 to 410-3), multiple radio circuits (e.g., 420-1 to 420-3), a baseband processor (e.g., a WEJE processor) 450, and a weight processor 460. The baseband processor may include among other components a number of finite-impulse response (FIR) filters (e.g., N, for example, 3 multi-tap temporal FIR filters such as 440-1 to 440-3). In one or more implementations of the subject technologies, a count of the antenna elements and the corresponding radio circuits and FIR filters may be more than the three shown in FIG. 4.

Each of the radio circuits 420-1 to 420-3 may include, but is not limited to, a de-hopping circuit and a down-converter mixer. In some aspects, the de-hopping circuit on each spatial antenna aperture isolates the hopping bandwidth (BW) of the SOI from the full-spreading bandwidth BH. The down-converter mixer may translate the SOI frequency to baseband. The baseband signal from each radio circuit 420-1 to 420-3 may be processed by a multi-tap temporal FIR filter (e.g., 440-1). The output of various taps of the each multi-tap temporal FIR filter (e.g., 440-1) can be combined by a summation circuit 444 to create an output for each of the antenna elements (e.g., N such as three antenna elements). Each FIR filter (e.g., 440-1) on each antenna element can include a number of multipliers (e.g., 442 and 446) and a number of taps (e.g., T taps), each tap corresponding to a weight, $\text{Weight}_{U,F,N,1:T}$. Where the indices U, F, N, and 1:T, respectively, represent the FH-TDMA (or TDMA) user, the frequency sub-band, the antenna number, and the temporal taps, 1:T. In some aspects, the final summation, in the baseband processor 450 by the summation circuit 452, of FIR filters from all antenna elements completes the spatial temporal WEJE processing.

Each of the temporal delays (e.g., 430-1 to 430-3) may account for a signal delay (e.g., not just a phase shift) between the multiple antenna apertures, and can allow deep nulls to be formed despite the signal and jammer temporal de-correlation caused by the delay between antenna elements (e.g., 410-1 to 410-3). Separate weights can be used for each FH-TDMA (or pure TDMA) user and frequency sub-band to allow WEJE to point optimal beams at each user and for each frequency sub-band while nulling all jammers in the environment (up to the number adaptive antenna elements minus 1, e.g., N−1). Adaptive spatial nulling systems that use antenna elements spaced far apart are better at copying SOIs and nulling jammers when the angular separation between the SOI and the jammer is small (e.g., small jammer-SOI standoff distance). Generally, the greater the antenna spacing the smaller the Jammer-SOI standoff distance that can be tolerated while still nulling the jammer. However, at some point, using large antenna spacing may result in grating lobes that lie within the main beams of the antenna. It is known that grating lobes may occur when the electrical difference between the jammer and the SOI becomes nearly zero. If a grating lobe is created, the ability to reduce or eliminate the jammer while copying the SOI may be lost, as the jammer and the SOI may appear identical electrically, so one may not be nulled without nulling the other. The WEJE technique when used with sparse aperture nulling (SAN) can allow the adaptive system to combine both short-baseline antennas (e.g., short separation between antenna elements) and long-baseline antenna elements to simultaneously allow jammer nulling and SOI copy (e.g., by suppression of grating lobes) and achieve very small jammer SOI standoff distances.

For example, in the satellite depicted in FIG. 2B, the three MBA antennas 220, 230, and 240 are separated by long-baselines on the nadir deck 210 of a satellite. Each MBA (e.g., 230) has seven beams that are formed from short-baselines MBA feed elements within the MBA 232. WEJE/SAN can allow combining the three long-baseline antennas pointed at a geographic area on the earth, and additionally, combine the six short-baseline adjacent antenna beams to create a long/short-baseline beamforming/nulling system that can achieve signal copy with substantially small jammer-SOI standoff distance. The long-baseline antennas can allow for good performance at low jammer-SOI standoff distance. The short-baseline antennas can allow for grating lobe suppression. In some aspects, a system using long and short-baseline antennas (e.g., combined via WEJE/SANS) both suppresses grating lobes, and allows for a short jammer-SOI separation.

Returning to FIG. 4, the weight processor 460 (e.g., WEJE weight processor (WWP)) is configured to determine the optimal WEJE spatial/temporal weights to copy the frequency hopped TDMA (FH-TDMA, or pure TDMA) signal-of-interest (SOI) and null any jammers. In one or more aspects, the WEJE system 400 automatically points an optimal beam in the direction of each of the frequency-hopped TDMA users and directs deep nulls at all jammers in the environment. WEJE beamforming/nulling weights can be tailored to each frequency sub-band and each FH-TDMA (or pure TDMA) user, creating an optimal system for SOI copy and jammer suppression. The WEJE system 400 may create separate spatial/temporal weights for each user, in multiple frequency sub-bands, for each antenna element, and each temporal delay. This allows the WEJE system 400 to create sharp nulls and beams across a wide bandwidth, tailored and optimized for each specific FH-TDMA (or pure TDMA) user. In one or more implementations, the weight processor 460 may determine the optimal weights by using one of several techniques including Cholesky decomposition, singular-value decomposition (SVD), pseudo-inverse decomposition, and generalized SVD.

Figure 5:
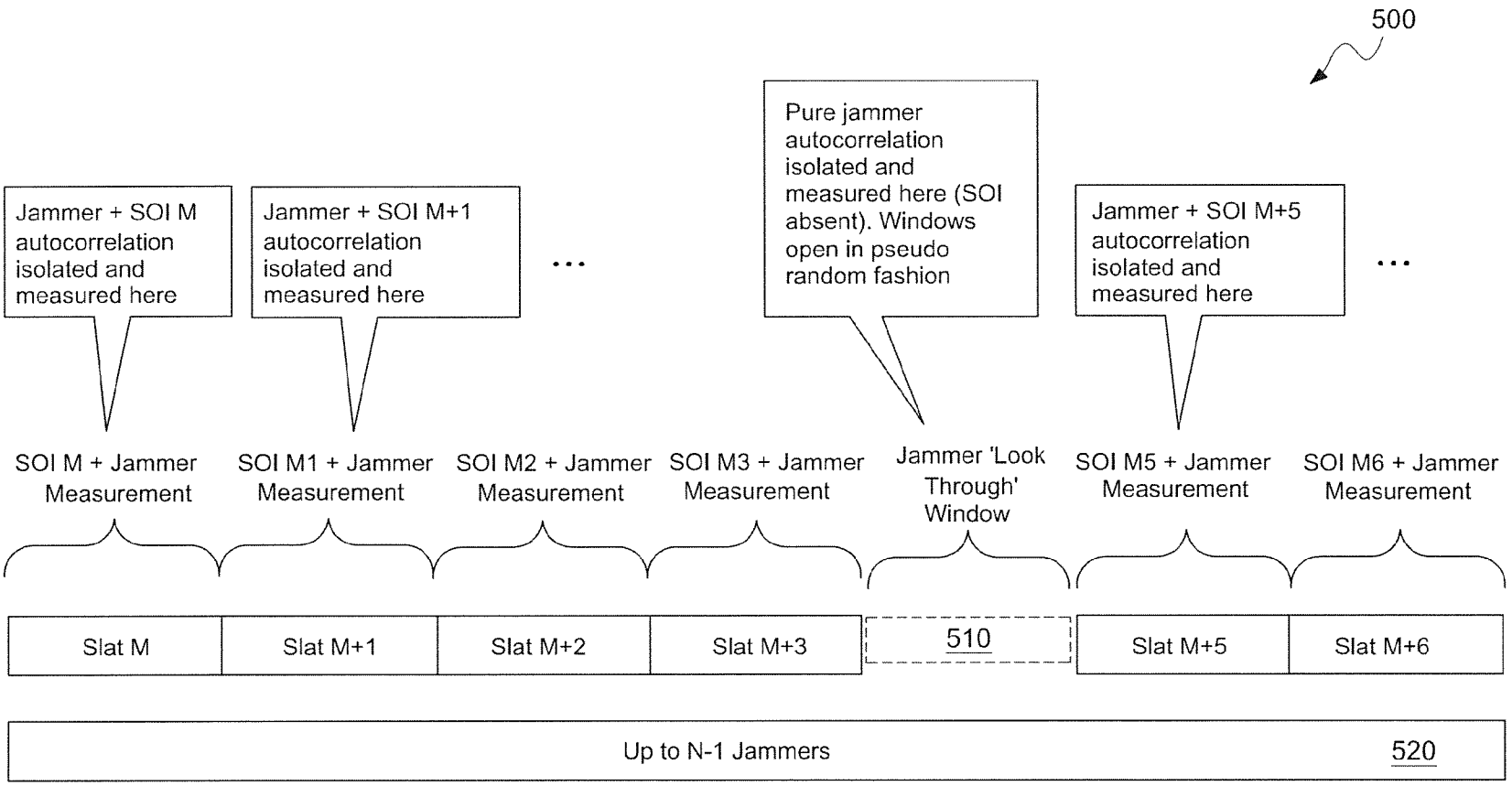
FIG. 5 is a conceptual diagram illustrating an example of a method of measuring pure jammer autocorrelation matrix using a look-through window, according to certain aspects.

FIG. 5 a conceptual diagram illustrating an example of a method 500 of measuring pure jammer autocorrelation matrix using a look-through window 510, according to certain aspects of the subject technology. Each FH-TMDA signal includes a series of time slots (e.g., slot M to slot M+6). These time slots contain a particular user signal known by a system controller (e.g., the baseband processor 150 of FIG. 1 or a separate controller not shown in FIG. 1). One method of measuring pure jammer autocorrelation matrix is to arrange, through the system controller, to not have a SOI present during a particular frequency-hop time-slot (e.g., slot M+4) to create a 'look-through' window 510, where pure jammer autocorrelation matrix can be measured. In one or more implementations, the multiple radio circuits (e.g., 420-1 to 420-3) of FIG. 4 may determine the look-through window during which no SOI is present. These measurements may be made across each of the frequency sub-bands BW of the full-spreading bandwidth BH. The jammer 510, as shown, may include up to N−1 jammers which are present during all time slots. Another technique for measuring pure jammer autocorrelation matrix may include having a separate de-hopper circuit operating orthogonally in frequency to all other FH-TDMA carriers. This can allow the measurement of pure jammer autocorrelation matrix without any jammer look-through windows. However, this technique may require the inclusion of an additional de-hopper circuit that operates orthogonally to the SOI frequency hopping.

The WEJE technique further includes measurement of SOI-plus-jammer spatial/temporal autocorrelation matrix for each FH-TDMA user in each frequency sub-band. These spatial/temporal autocorrelation matrices can be measured whenever the SOI is transmitting. An autocorrelation matrix may be measured for each user in the FH-TMDA system at each frequency sub-band. With the measured autocorrelation matrix information as described above, the WEJE technique can facilitate the optimal SOI beamforming.

Figure 6:
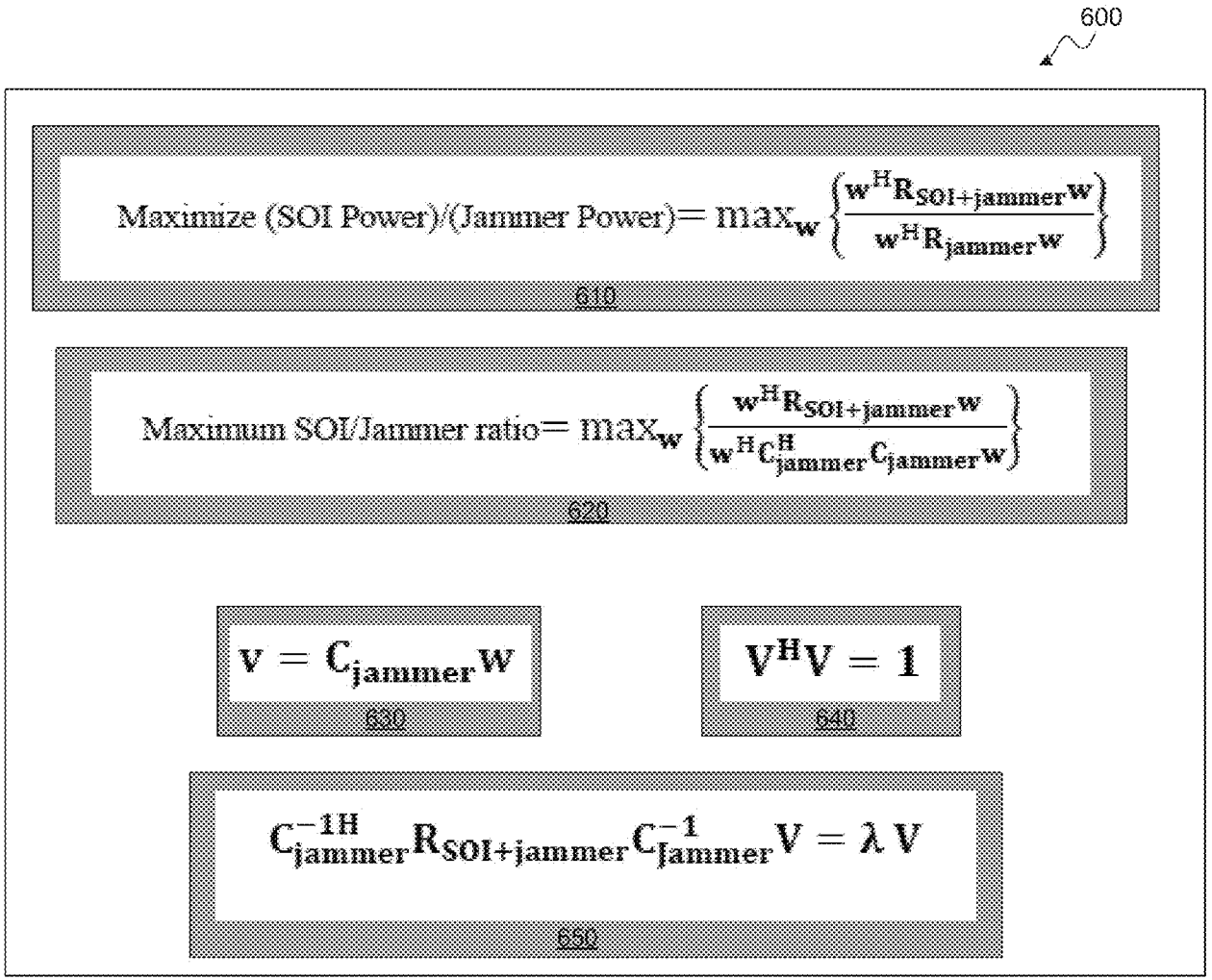
FIG. 6 is a diagram illustrating basic underlying equations of an exemplary method of waveform-enabled jammer excision, according to certain aspects.

FIG. 6 is a diagram illustrating basic underlying equations 600 of an exemplary method of waveform-enabled jammer excision, according to certain aspects of the subject technology. The WEJE method may be implemented by using several matrix decomposition techniques including Cholesky decomposition, singular-value decomposition (SVD), pseudo-inverse decomposition, and generalized SVD. For example, the Cholesky decomposition method may be appropriate if it can be ensured that an autocorrelation component of the received noise with the received signal is invertible (e.g., the matrix is invertible and not ill-conditioned). This can occur if the receiver noise floor occupies at least the lower 10-dB of the ADC dynamic range, which is usually the case. The system AGC may normally be set to ensure the ADC noise floor is set below the thermal noise floor by about 10-dB to prevent the ADC noise from degrading the overall system noise figure.

It is understood that WEJE is an optimal spatial/temporal interference cancellation technique tailored for frequency-hopped TDMA signals (FH-TDMA, or pure TDMA). The WEJE method may produce maximum signal-to-noise-plus-interference weights for frequency hopped signals or TDMA signals to copy the SOI within a beam and null in-band jammer signals. In one or more implementations, the WEJE method can form the optimal SOI beamforming and jammer nulling weight vector in a substantially short time with minimal number of aperture samples. A WEJE system (e.g., the system 400 of FIG. 4) may automatically and completely blindly point beams at the SOIs and null at the jammers, and obtain maximum signal-to-interference-plus noise copy on the SOI. In some aspects, knowledge of the array aperture (e.g., manifold) or the direction-of-arrival of the SOI or the jammers is not needed. The WEJE method can include measurement of the jammer characteristics and apertures during 'look-through' windows (or with an orthogonal de-hopper as previously described) when no SOIs are transmitting. The WEJE method may also include measurement of SOI+Jammer autocorrelation matrices when both SOI and jammer are present.

With the above-described knowledge, a WEJE processor (e.g., baseband processor 450 of FIG. 4) can compute the optimal SOI beamforming and jammer nulling weights to copy the SOI and null any jammers. The underlying theory behind the WEJE method is described herein. When WEJE is used on FH-TMDA or TDMA systems, a separate optimal user beamforming and jammer nulling weight is produced for each user of the FH-TDMA or TDMA systems. Furthermore, weights optimized for each frequency sub-band of a wideband frequency hopping system and for each of the FH-TDMA users within the sub-band are designed. The WEJE technique is an optimal spatial interference cancellation technique tailored for use with frequency hopped TDMA signals. The WEJE processor can collect samples from a receive aperture including N antenna elements and T temporal delays, and determines the optimal WEJE beamforming and null steering weights, that copy the signal-of-Interest (SOI) and null all jammers, by maximizing the (SOI-plus-Jammer)/jammer power ratio shown in Equation 610, also given as (1) below:

$$\text{Maximize } (SOI \text{ Power})/(\text{Jammer Power}) = \max_w \left\{ \frac{w^H R_{SOI+jammer} w}{w^H R_{jammer} w} \right\} \quad (1)$$

The maximization problem expressed in (1) can be solved by first performing a Cholesky factorization on $R_{jammer}$ to arrive at Equation 620, also shown as (2) below:

$$\text{Maximize } SOI/\text{Jammer ratio} = \max_w \left\{ \frac{w^H R_{SOI+jammer} w}{w^H C_{jammer}^H C_{jammer} w} \right\} \quad (2)$$

Where $C_{jammer}$ is the Cholesky factorization of $R_{jammer}$. Next a new vector v as shown by Equation 630 is defined, that converts (2) to:

$$\text{Maximize } SOI/\text{Jammer ratio} = \max_w \left\{ \frac{V^H C_{jammer}^{-1H} R_{SOI+jammer} C_{jammer}^{-1} V}{V^H V} \right\} \quad (3)$$

The maximization is performed by taking derivative of (3) subject to the constraint that that the weights are normalized, as expressed by Equation 640 and given here:

$$V^H V = 1 \quad (4)$$

The derivative is taken with respect to $V^H$, subject to the constraint of (4), and setting the result to zero. This may result in the Equation 650 shown as (5) below:

$$C_{jammer}^{-1H} R_{SOI+jammer} C_{Jammer}^{-1} V = \lambda V \quad (5)$$

This is now reduced to a classic eigen-equation, and the maximum SNIR corresponds to the eigenvector associated with the maximum eigenvalue of: $C_{jammer}^{-1H} R_{SOI+jammer} C_{Jammer}^{-1}$, which is an eigenvector associated with the maximum eigenvalue of $R_{soi+jammer}$ whitened by the inverse Cholesky factor of the Jammer autocorrelation matrix that can be called $V_{opt}$. The optimal beamforming and null steering weights are then:

$$w_{opt} = C_{Jammer}^{-1} v_{opt} \quad (6)$$

The WEJE beamforming/nulling weights can be determined in a more general way that is applicable even if the noise autocorrelation matrix is ill-conditioned. In one or more embodiments, it is possible that the jammers may only be partial band or may be pulsed. Jammer autocorrelation matrices may be collected over time and over frequency sub-bands. The jammer autocorrelation used by WEJE can be the one with the most jammers and the most power collected over a time interval of T seconds. The WEJE technique may determine the jammer power by summing the diagonal elements of the jammer-only autocorrelation matrix. The WEJE technique may further determine the number of jammers present by determining the number of eigenvalues above the noise floor of the jammer-only autocorrelation matrix.

Figure 7:
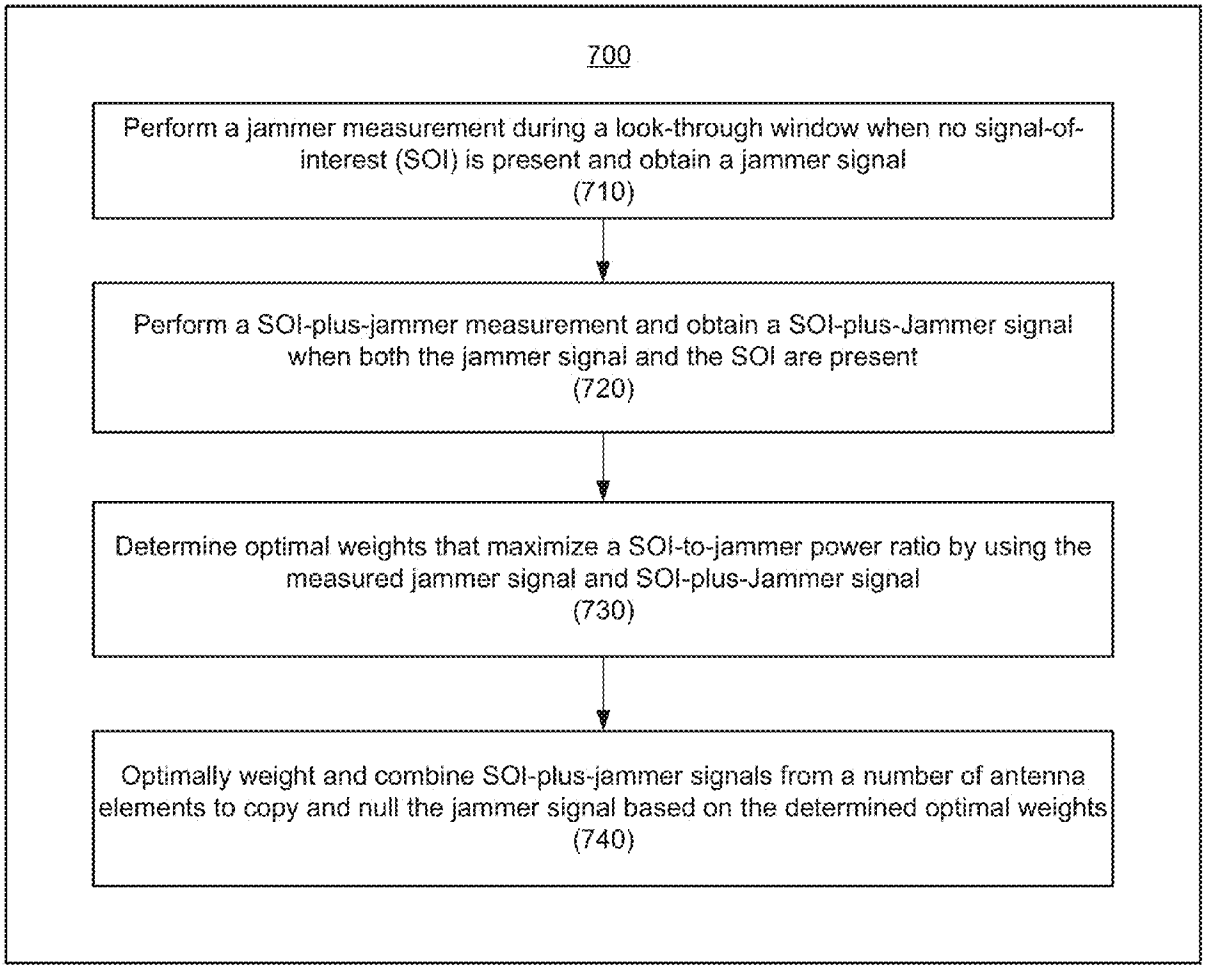
FIG. 7 is a flow diagram illustrating an example method for waveform-enabled jammer excision, according to certain aspects.

FIG. 7 is a flow diagram illustrating an example method 700 for WEJE, according to certain aspects of the subject technology. The method 700 starts at operation block 710, where a jammer measurement is performed (e.g., by system 400 of FIG. 4) during a look-through window (e.g., 510 of FIG. 5) when no signal-of-interest (SOI) is present and a jammer signal is obtained. At operation block 720, a SOI-plus-jammer measurement may be performed (e.g., by system 400 of FIG. 4) and a SOI-plus-Jammer signal may be obtained when both the jammer signal and the SOI are present (e.g., at slots M to M+3 and M+5 to M+6 of FIG. 5). At operation block 730, optimal weights that maximize a SOI-to-jammer power ratio may be determined (e.g., by the weight processor 460 of FIG. 4). At operation block 740, SOI-plus-jammer signals from a number of antenna elements may be optimally weighted and combined to copy and null the jammer signal based on the determined optimal weights (e.g., by the WEJE processor 450 of FIG. 4).

The WEJE technique disclosed herein can create optimal beamforming weights to copy a frequency-hopped or TDMA SOI in the presence of interference and jamming. No knowledge of the array aperture or the direction-of-arrival of either the SOI or the jammers is required. The WEJE technique may include measurement of the jammer characteristics and apertures during a look-through window when no SOI is transmitting. The disclosed technique further includes measurement of SOI-plus-jammer autocorrelation matrices when both SOI and jammer are present. With just this knowledge, the subject technique can determine the optimal beamforming and nulling weights to copy the SOI and null any jammers.

In some aspects, the subject technology is related to jammer excision, and in particular to methods and configurations used for waveform-enabled jammer excision. In some aspects, the subject technology may be used in various markets, including for example and without limitation, data transmission and communications markets. Furthermore, any TDMA-based wireless base-station may benefit from the present technology. Wireless base-stations tend to interfere with one-another if operated on the same frequency. Because of this, base-station frequencies may not be re-used unless the physical separation between the stations is large enough to ensure there is not self-inference between the stations. Because re-use of frequency may be restricted by self-interference, the overall capacity of existing TDMA systems may be limited due to self-interference. However, if WEJE is applied at these base-stations, the scarce RF frequency spectrum can be reused more often (e.g., less physical spacing between base stations that re-use a particular frequency). WEJE may spatially null self-interference, allowing the re-use of scarce RF spectrum more often. This may have the effect of increasing the capacity of commercial base-stations within a given allocated RF spectrum (e.g., the capacity within the cellular bands can be increased without finding and buying additional RF spectrum).

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. A method for waveform-enabled jammer excision (WEJE), the method comprising:

performing a jammer measurement across each frequency sub-band of a full-spreading bandwidth during a look-through window comprising a predefined frequency-hop time-slot when no signal-of-interest (SOI) is transmitting and obtaining a jammer signal, wherein the look-through window is characterized by a frequency and a bandwidth;

performing a SOI-plus-jammer measurement and obtaining a SOI-plus-jammer signal when both the jammer signal and the SOI are present;

determining optimal weights that maximize a SOI-to-jammer power ratio by using the measured jammer signal and SOI-plus-jammer signal;

optimally weighing and combining SOI-plus-jammer signals associated with a number of antenna elements to copy the SOI and null the jammer signal based on the determined optimal weights; and performing beam-forming and jammer signal nulling using three multi-beam antennas (MBAs) arranged in a triangle on a satellite, and forming 2*B jammer nulls, wherein each MBA includes B beams and B is greater than seven.

2. The method of claim 1, wherein the jammer measurement comprises:

at least one of a spatial or temporal interference measurement, a jammer characteristics and aperture measurement; and a jammer auto-correlation measurement.

3. The method of claim 1, wherein:

the SOI-plus-jammer measurement comprises a SOI-plus-jammer auto-correlation measurement, the SOI comprises a pure time-division multiple-access (TDMA) signal, or a wide-band frequency-hopped (FH)-TDMA signal, and the optimal weights comprise optimal SOI beam-forming and jammer nulling weights.

4. The method of claim 1, wherein the look-through window is characterized by a time-slot, and wherein performing the method is independent of direction of arrivals of the jammer signal and the SOI.

5. The method of claim 1, wherein the jammer signal comprises a broadband jammer signal, a partial-band jammer signal, and a pulsed jammer signal, and wherein determining optimal weights comprises optimizing SOI-to-interference-plus noise ratio for individual users.

6. The method of claim 1, wherein nulling the jammer signal comprises forming one or more deep nulls over a wide bandwidth, wherein nulling the jammer signal is performed in conjunction with adaptive modulation and coding, and wherein nulling the jammer signal allows sparse aperture nulling (SAN) by using sparse aperture antenna element spacing.

7. The method of claim 1, further comprising copying SOIs within the beams.

8. The method of claim 1, further comprising beam-forming and nulling that is performed by using multiple antenna elements with different gains, and wherein beam-forming and nulling is performed via pseudo-inverse decomposition, singular value decomposition (SVD), or generalized SVD when autocorrelation matrices are ill-conditioned.

9. A system for waveform-enabled jammer excision (WEJE), the apparatus comprising:

a plurality of antennas configured to enable communication over a coverage area through a plurality of antenna beams;

a plurality of radio circuits coupled to the plurality of antennas and configured to measure a jammer signal across each frequency sub-band of a full-spreading bandwidth during a look-through window comprising a predefined frequency-hop time-slot when during which no signal-of-interest (SOI) is transmitting and to measure SOI-plus-jammer signal when both the jammer signal and the SOI are present, wherein the look-through window is characterized by a frequency and a bandwidth;

a weight processor coupled to the plurality of radio circuits and configured to:

receive the jammer signal during the look-through window and to receive the SOI-plus-jammer signal; and determine optimal weights that maximize a SOI-to-jammer power ratio;

a baseband processor coupled to the plurality of radio circuits and the weight processor and configured to:

receive the jammer signal and the SOI-plus-jammer signal from the plurality of radio circuits;

receive the optimal weights from the weight processor;

optimally weigh and combine the SOI-plus-jammer signals associated with a number of antenna elements to optimally copy the SOI and null the jammer signal based on the determined optimal weights; and perform beam-forming and jammer signal nulling using three multi-beam antennas (MBAs) arranged in a triangle on a satellite, and form 2*B jammer nulls, wherein each MBA includes B beams and B is greater than seven.

10. The system of claim 9, wherein the plurality of antennas comprise a single multi-beam antenna (MBA), separate gimbaled dish antenna (GDA), or an array of antennas, and wherein the apparatus is configured to perform the WEJE without knowledge of an antenna configuration including an antenna array aperture.

11. The system of claim 9, wherein:

the radio circuit comprises a de-hopping circuit and a down-converter mixer, the de-hopping circuit is configured to:

isolate the hopping bandwidth of the SOI;

operate orthogonally to SOI hops; and allow measurement of pure jammer autocorrelation matrix without the look-through window, the down-converter mixer is configured to down-convert the SOI to baseband, and the SOI comprises a pure time-division multiple-access (TDMA) signal, or a wide-band frequency-hopped (FH)-TDMA signal.

12. The system of claim 9, wherein the baseband processor is configured to perform:

at least one of a spatial or temporal interference measurement, a jammer characteristics and aperture measurement;

a jammer auto-correlation measurement; and a SOI-plus-jammer auto-correlation measurement.

13. The system of claim 9, wherein:

the weight processor is further configured to determine the optimal weights that comprise optimal SOI beam-forming and jammer nulling weights, the weight processor is further configured to determine the optimal weights by using one of a plurality of techniques including Cholesky decomposition, singular-value decomposition (SVD), pseudo-inverse decomposition, and generalized SVD, the look-through window is characterized by a time-slot, and optimal SOI beam-forming and jammer nulling weights do not require information on direction of arrivals of the jammer and the SOI.

14. The system of claim 9, wherein:

the jammer signal comprises a broadband jammer signal, a partial-band jammer signal, and a pulsed jammer signal, the weight processor is further configured to optimize SOI-to-interference-plus noise ratio for individual users, the baseband processor is capable of nearly instantaneously forming beams on each user individually and nulling on interferers for FH-TDMA and TDMA signals, and the baseband processor is capable of leveraging beam-forming gain to make disadvantaged terminals harder to detect.

15. The system of claim 9, wherein:

the baseband processor comprises a plurality of finite-impulse response (FIR) filters each coupled to one of the plurality of antennas, the baseband processor is configured to receive optimal weights that are characterized by a plurality of indices, the plurality of indices comprise a first index that indicates a user, a second index that represents a frequency sub-band, a third index that indicates an antenna number associated with each of the plurality of antennas, and a fourth index that is an index that represents a temporal tap.

16. The system of claim 9, wherein the baseband processor is further configured to:

null the jammer signal by forming one or more deep nulls over a wide bandwidth, wherein nulling the jammer signal is performed in conjunction with adaptive modulation and coding, and wherein nulling the jammer signal allows sparse aperture nulling (SAN) by using sparse aperture antenna element spacing.

17. The system of claim 9, wherein the baseband processor is further configured to:

perform beam-forming and nulling by combining both short and long baseline antenna elements; and simultaneously copy SOIs with small Jammer-SOI stand-off distance and eliminate grating lobes.

18. The system of claim 9, wherein the baseband processor is further configured to perform beam-forming and nulling by using multiple antenna elements with different gains, and wherein the baseband processor is further configured to perform beam-forming and nulling via matrix pseudo inverse square roots, singular value decomposition (SVD, or generalized SVD when autocorrelation matrices are ill-conditioned.

19. A satellite communication system, comprising:

a plurality of multi-beam antennas (MBAs) arranged at wide separations, each MBA configured to communicate through multiple beams pointed at different regions on the earth;

a plurality of radio circuits coupled to the plurality of MBAs and configured to measure a jammer signal across each frequency sub-band of a full-spreading bandwidth during a look-through window comprising a predefined frequency-hop time-slot when no signal-of-interest (SOI) is transmitting and to measure SOI-plus-jammer signal when both the jammer signal and the SOI are present, wherein the look-through window is characterized by a frequency and a bandwidth;

a weight processor coupled to the plurality of radio circuits and configured to:

receive the jammer signal and the SOI-plus-jammer signal; and determine optimal weights that maximize a SOI-to-jammer power ratio based on the received jammer signal and the SOI-plus-jammer signal;

a baseband processor coupled to the plurality of radio circuits and the weight processor and configured to:

receive the jammer signal and the SOI-plus-jammer signal from the plurality of radio circuits;

receive the optimal weights from the weight processor;

optimally weigh and combine SOI-plus-jammer signals associated with a number of antenna elements and optimally copy the SOI and null the jammer signal based on the determined optimal weights; and perform beam-forming and jammer signal nulling using three multi-beam antennas (MBAs) arranged in a triangle on a satellite, and form 2*B jammer nulls, wherein each MBA includes B beams and B is greater than seven.

20. The satellite communication system of claim 19, wherein:

the radio circuit comprises a de-hopping circuit and a down-converter mixer, the de-hopping circuit is configured to:

isolate the hopping bandwidth of the SOT;

operate orthogonally to SOI hops; and allow measurement of pure jammer autocorrelation matrix without the look-through window, the down-converter mixer is configured to down-convert the SOI to baseband, the SOI comprises a pure time-division multiple-access (TDMA) signal, or a wide-band frequency-hopped (FH)-TDMA signal, the weight processor is further configured to determine the optimal weights that comprise optimal SOI beam-forming and jammer nulling weights, the weight processor is further configured to determine the optimal weights by using one of a plurality of techniques including Cholesky decomposition, singular-value decomposition (SVD), pseudo-inverse decomposition, and generalized SVD, the look-through window is characterized by a time-slot, and optimal SOI beam-forming and jammer nulling weights are independent of direction of arrivals of the jammer and the SOI.

* * * * *